US006991372B2

(12) United States Patent
Cornelisse

(10) Patent No.: US 6,991,372 B2
(45) Date of Patent: Jan. 31, 2006

(54) RECLOSABLE PACKAGES WITH FRONT PANEL SLIDER-ZIPPER ASSEMBLY

(75) Inventor: Jan Willem Cornelisse, Oosterhout (NL)

(73) Assignee: Illinois Tool Works Inc., Glenview, IL (US)

( * ) Notice: Subject to any disclaimer, the term of this patent is extended or adjusted under 35 U.S.C. 154(b) by 225 days.

(21) Appl. No.: 10/388,020

(22) Filed: Mar. 13, 2003

(65) Prior Publication Data

US 2004/0179755 A1 Sep. 16, 2004

(51) Int. Cl.
*B65D 33/16* (2006.01)

(52) U.S. Cl. ..... 383/64; 383/61.2; 383/66; 383/203; 383/210

(58) Field of Classification Search ..... 383/61.2, 383/64, 203–204, 66, 210; 53/412; 493/213
See application file for complete search history.

(56) References Cited

U.S. PATENT DOCUMENTS

| | | | | |
|---|---|---|---|---|
| 4,655,862 | A | 4/1987 | Christoff et al. | |
| 4,909,017 | A | 3/1990 | McMahon et al. | |
| 5,461,845 | A | 10/1995 | Yeager | |
| 5,672,009 | A * | 9/1997 | Malin | 383/204 |
| 5,681,115 | A | 10/1997 | Diederich et al. | |
| 5,782,733 | A | 7/1998 | Yeager | |
| 5,829,884 | A * | 11/1998 | Yeager | 383/45 |
| 5,954,433 | A | 9/1999 | Yeager | |
| 6,131,370 | A | 10/2000 | Ausnit | |
| 6,177,172 | B1 | 1/2001 | Yeager | |
| 6,212,857 | B1 * | 4/2001 | Van Erden | 53/412 |
| 6,270,257 | B1 * | 8/2001 | Yeager | 383/203 |
| 6,402,376 | B1 | 6/2002 | Bois | |
| 6,481,891 | B2 * | 11/2002 | Yeager | 383/203 |
| 6,659,643 | B2 * | 12/2003 | Plourde et al. | 383/61.2 |
| 6,694,704 | B1 * | 2/2004 | Ausnit | 53/412 |
| 2004/0062456 | A1 * | 4/2004 | Johnson | 383/5 |
| 2004/0066990 | A1 * | 4/2004 | Schneider | 383/204 |

FOREIGN PATENT DOCUMENTS

| | | |
|---|---|---|
| EP | 0528721 A2 | 2/1993 |
| EP | 1279612 A2 | 1/2003 |
| US | 2002-0037115 A1 | 3/2002 |

* cited by examiner

*Primary Examiner*—Jes F. Pascua
(74) *Attorney, Agent, or Firm*—Ostrager Chong Flaherty & Broitman P.C.

(57) ABSTRACT

A resealable package having a slider-operated zipper wherein the contents of the package are accessed through the front wall of the package, not through the top of the package. The resealable package comprises: a bag body comprising front and rear walls of bag making material; a flexible zipper joined to the front wall and not joined to the rear wall; and a slider mounted to the zipper, the slider being movable in a first direction along the zipper for opening the zipper and movable in a second direction along the zipper for closing the zipper. Alternatively, the flexible zipper is joined to the front wall along first and second zones of joinder disposed at different heights on the front wall, and is joined to the rear wall only in zones of joinder where the zipper is joined to both of the front and rear walls.

22 Claims, 4 Drawing Sheets

RECLOSABLE PACKAGES WITH FRONT PANEL SLIDER-ZIPPER ASSEMBLY

BACKGROUND OF THE INVENTION

This invention generally relates to slider-operated flexible zippers for use in reclosable pouches, bags or other packages of the type in which material, such as foodstuff, detergent, etc., may be stored.

Reclosable fastener assemblies are useful for sealing thermoplastic pouches or bags. Such fastener assemblies often include a plastic zipper and a slider. Typically, the plastic zippers include a pair of interlockable fastener elements, or profiles, that form a closure. As the slider moves across the profiles, the profiles are opened or closed. The profiles in plastic zippers can take on various configurations, e.g. interlocking rib and groove elements having so-called male and female profiles, interlocking alternating hook-shaped closure members, etc.

Conventional slider-operated zipper assemblies typically comprise a plastic zipper having two interlocking profiles and a slider for opening and closing the zipper. In one type of slider-operated zipper assembly, the slider straddles the zipper and has a separating finger at one end that is inserted between the profiles to force them apart as the slider is moved along the zipper in an opening direction. The other end of the slider is sufficiently narrow to force the profiles into engagement and close the zipper when the slider is moved along the zipper in a closing direction. Other types of slider-operated zipper assemblies avoid the use of a separating finger. For example, U.S. Pat. No. 6,047,450 discloses a zipper comprising a pair of mutually interlockable profiled structures, portions of which form a fulcrum about which the profiled structures may be pivoted out of engagement when lower edges of the bases are forced towards each other by the moving slider.

Reclosable bags are finding ever-growing acceptance as primary packaging, particularly as packaging for foodstuffs such as cereal, fresh vegetables, snacks and the like. Such bags provide the consumer with the ability to readily store, in a closed, if not sealed, package any unused portion of the packaged product even after the package is initially opened. To gain acceptance as a primary package for foodstuffs, it is virtually mandatory that the package exhibit some form of tamper evidence to protect the consumer and maintain the wholesomeness of the contained product. In addition, in many cases it is necessary that food product be hermetically packaged. This may readily be accomplished by forming a plastic bag of a film having the appropriate barrier properties. However, where the bag is provided with a zipper, a problem arises in properly sealing the bag at the opening to be closed by the zipper, since the zipper itself does not provide a hermetic seal. The presence of a slider that uses a zipper-opening separating finger on a zipper poses an additional impediment to hermetic sealing of the package since even in the fully closed park position, the opening end of the slider typically causes the zipper closure members to separate.

One solution is to problem of providing both tamper evidence and hermetic sealing is to manufacture packages wherein the slider-zipper assembly is enclosed by a header. Before anyone can open the zipper and tamper with the contents of the package, the header must be torn at least partly, leaving evidence to dissuade any consumer from buying that package. Also, since the header is contiguous with the bag body, the fully enclosed zipper does not interfere with hermetic sealing of the package.

Many existing form-fill-seal (FFS) machines operate on bag making film and do not incorporate equipment for attaching zipper assemblies to the bag making film. However, zipper application machines are available that can be coupled to the FFS machine to provide the zipper application function. In addition, a slider insertion device may be incorporated as part of the zipper application station. However, operators of FFS machines who do not wish to purchase a zipper applicator and a slider inserter require that bag making film with slider-zipper assemblies be available for purchase. This film can then be run through the FFS machine. Although the packager may need to modify his FFS machine to handle bag making film with slider-zipper assemblies attached, including providing clearance for the sliders to pass through the machine, the major capital investment of a zipper application system can be avoided.

There is a need for an improved reclosable package design whereby bag making film with preattached slider-zipper assemblies can be formed, filled and sealed without the FFS machine needing to perform any zipper application step.

BRIEF DESCRIPTION OF THE INVENTION

The present invention is directed to slider-zipper assemblies having a particular structure, to bag making film having such slider-zipper assemblies fully attached to the film prior to bag manufacture, to reclosable packages made from such bag making film with pre-attached slider-zipper assemblies, and to related methods of manufacture. The final package has a tear-out section in the front wall or panel that provides ready access to the slider-zipper assembly, which when opened, in turn provides ready access to the package contents.

One aspect of the invention is a reclosable package comprising: a bag body having an interior space, the bag body comprising first and second walls of bag making material, the first wall opposing the second wall; a flexible zipper joined to the first wall, the zipper being in the interior space of the bag body; and a slider mounted to the zipper, the slider being movable in a first direction along the zipper for opening the zipper and movable in a second direction along the zipper for closing the zipper. The zipper comprises first and second zipper parts that are mutually engageable to close the zipper and mutually disengageable to open the zipper, the first zipper part comprising a first profiled closure member and a first flange connected to the first closure member, and the second zipper part comprising a second profiled closure member that is interlockable with the first closure member and a second flange connected to the second closure member, the first flange being longer than the second flange. A first portion of the first flange is joined to the first wall along a first zone of joinder at an elevation below the first and second profiled closure members, and a second portion near a distal end of the first flange is joined to the first wall along a second zone of joinder at an elevation above the first and second profiled closure members.

Another aspect of the invention is a reclosable package comprising: a bag body comprising first and second walls of bag making material; a flexible zipper disposed between the first and second walls; and a slider mounted to the zipper, the slider being movable in a first direction along the zipper for opening the zipper and movable in a second direction along the zipper for closing the zipper. The zipper comprises first and second zipper parts that are mutually engageable to close the zipper and mutually disengageable to open the zipper, the first zipper part comprising a first profiled closure member and a first flange connected to the first closure member, and the second zipper part comprising a second profiled closure member that is interlockable with the first closure member and a second flange connected to the second closure member, the first flange being longer than the second flange. The first flange is joined to the first wall along first and second zones of joinder disposed at different heights on the first wall, and is joined to the second wall in the second zone of joinder, the second flange being joined to the first flange along a third zone of joinder disposed intermediate the first and second zones of joinder along the length of the first flange.

A further aspect of the invention is a method of manufacturing bag making film with preattached slider-zipper assemblies, each slider-zipper assembly comprising first and second profiled closure members that are mutually interlocked, and first and second zipper flanges respectively connected to the first and second closure members, the first flange having a length greater than the length of the second flange. The method comprises the following steps: (a) folding a portion of a first zipper flange of a slider-zipper assembly around a second zipper flange; (b) joining the second zipper flange to the folded-over portion of the first zipper flange; (c) placing a length of bag making film under tension; (d) placing the slider-zipper assembly on the tensioned length of bag making film in a predetermined position; (e) joining an unfolded portion of the first zipper flange to the bag making film in a first zone of joinder while the slider-zipper assembly is in the predetermined position relative to the bag making film; and (f) joining the folded portion of the first zipper flange to the bag making film in a second zone of joinder while the slider-zipper assembly is in the predetermined position relative to the bag making film. The first zone of joinder is located on the bag making film on one side of the first and second closure members, while the second zone of joinder is located on the bag making film on the other side of the first and second closure members.

Yet another aspect of the invention is an article of manufacture comprising a sheet of bag making film having a multiplicity of slider-zipper assemblies attached thereto at spaced intervals therealong, each slider-zipper assembly comprising first and second profiled closure members that are mutually interlocked, first and second zipper flanges respectively connected to the first and second closure members, and a slider mounted to the first and second profiled closure members. Each first zipper flange comprises a first portion joined to the film in a respective first zone of joinder located on one side of the interlocked first and second closure members and a second portion carried over the second zipper flange and the interlocked first and second closure members and joined to the film in a respective second zone of joinder located on the other side of the interlocked first and second closure members.

A further aspect of the invention is a slider-zipper assembly comprising first and second profiled closure members that are mutually interlocked, first and second zipper flanges respectively connected to the first and second closure members, the first flange being longer than the second flange, and a slider mounted to the first and second profiled closure members, wherein the first flange is folded so that first and second portions of the first flange are disposed on opposing sides of the second flange, and a third portion of the first flange extends beyond the interlocked first and second profiled closure members in a direction substantially opposite to the first portion of the first flange, and the second zipper flange comprises a portion joined to the second portion of the first zipper flange along a longitudinal zone of joinder.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

Figure 1:
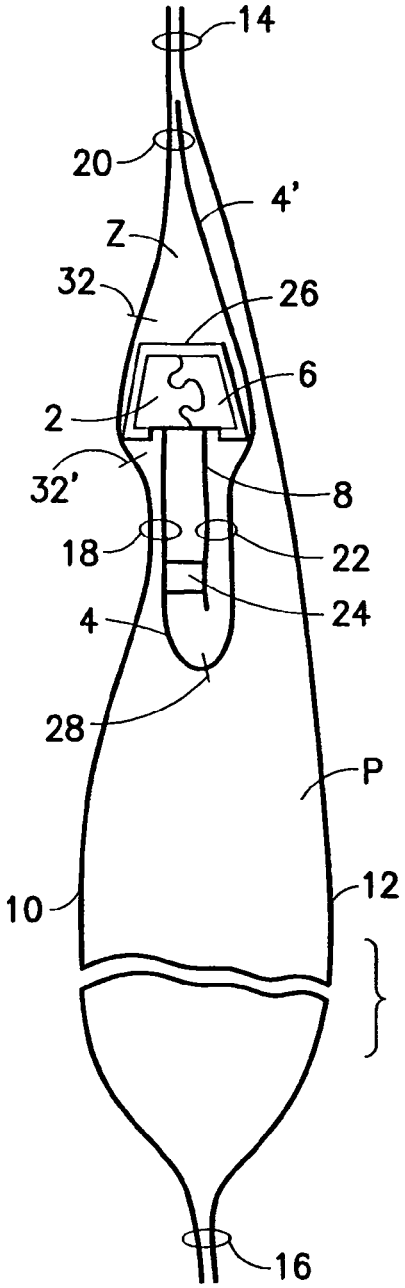
FIG. 1 is a drawing showing a sectional view of a reclosable package that is designed to open on its front panel in accordance with one embodiment of the present invention. The ovals represent seals or seams formed by conduction heat sealing.

FIG. 1 depicts a reclosable package in accordance with one embodiment of the present invention. The bag body comprises a front wall 10 and a rear wall 12 having top edges joined at a top seam 14 and bottom edges joined at a bottom seam 16 by any conventional means, e.g., conduction heat sealing. Although not shown, the front and rear walls are portions of a tube of bag making material formed by wrapping the film around a fill tube and then forming a fin seal 34 by conduction heat sealing the overlapping edges of the film together. The tube is cross sealed to form the top and bottom seams 14 and 16. However, the broad concept of the invention encompasses the use of bag bodies comprising front and rear panels, the edges of which are joined on four sides to form top, bottom and two side seams; and bag bodies having front and rear walls connected by respective gusseted side walls. The broad concept of the invention also encompasses the use of bag bodies having a pair of side seams, a bottom seam and a fold in place of a top seam, and bag bodies having a pair of side seams, a top seam and a fold in place of a bottom seam. In addition, bag bodies comprising a bottom wall contiguous with the bottom edges of the front and rear walls and the bottom edges of a pair of side walls (optionally gusseted) can be used.

The walls of the bag body comprise thermoplastic web material or film. The bag walls may be formed of various types of thermoplastic material, such as low-density polyethylene, substantially linear copolymers of ethylene and a C3–C8 alpha-olefin, polypropylene, polyvinylidene chloride, mixtures of two or more of these polymers, or mixtures of one of these polymers with another thermoplastic polymer. The person skilled in the art will recognize that this list of suitable materials is not exhaustive. The preferred thermoplastic materials are polyethylene and polypropylene.

A slider-zipper assembly is mounted to or attached on the front wall 10 of the bag. The slider-zipper assembly depicted in FIG. 1 comprises a zipper and a slider 26 mounted to or over the zipper. The zipper comprises two zipper parts, one of which is heat sealed, bonded or otherwise joined to the front wall 10 of the bag body. The other zipper part is interlocked with and joined to the first zipper part. In the disclosed embodiment, one zipper half comprises an interlockable profiled closure member 2 having a male profile and the other zipper half comprises an interlockable profiled closure member 6 having a female profile designed to receive and interlock with the male closure member 2. Many different rib-and-groove arrangements are known in the art. Alternatively, the zipper may comprise alternating hook-shaped closure members that interleave when the zipper halves are brought together. The present invention may employ any type of flexible plastic zipper suitable for being operated by manipulation of a slider.

Figure 2:
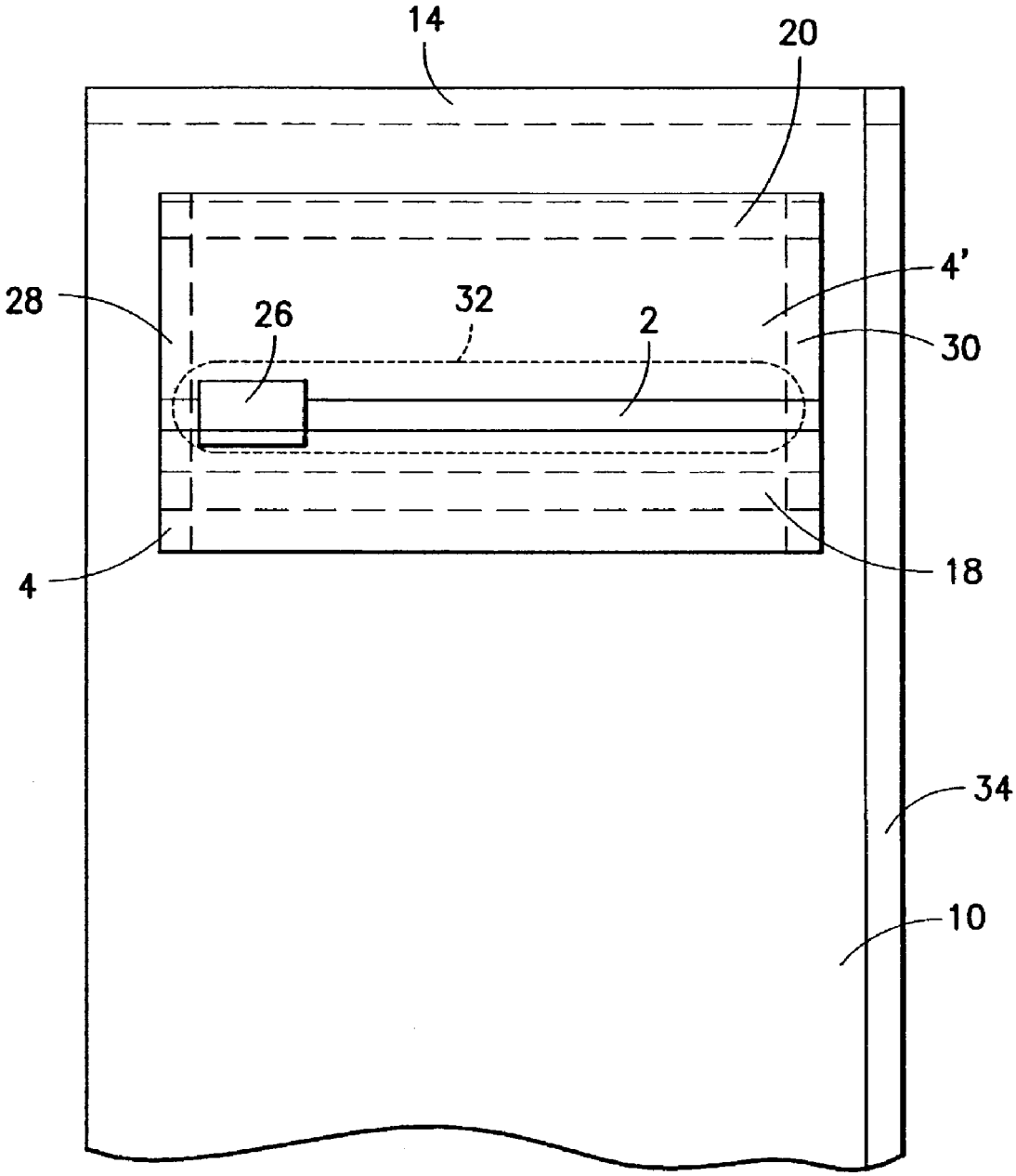
FIG. 2 is a drawing showing a front view of the reclosable package depicted in FIG. 1.

Each zipper part also comprises a flange or fin 4 having one end connected to the profiled closure member 2 and a flange or fin 8 having one end connected to the profiled closure member 6. The flange 4 is longer than the flange 8 and is folded around the bottom of the flange 8 to form a cusp. The folded portion 4' of the flange 4 extends in the reverse direction to a location above the profiled closure members 2 and 6. Respective proximal and distal portions of the flange 4 are joined to the front wall 10 of the bag body along respective zones of joinder 18 and 20 that extend the full length of the zipper. The joinder zones may be formed by conduction heat sealing, application of adhesive or any other suitable technique for joining thermoplastic materials. These permanent seals 18 and 20 are indicated by bands bounded by parallel dashed lines in FIG. 1. It should be appreciated that each permanent seal 18 and 20 is a band of joined, e.g., fused, material that extends from one end of the zipper to the other, thereby securing the zipper flange 4 to the bag body along the length of the zipper, as shown in FIG. 2.

The flange 8 is joined to an intermediate portion of the flange 4 along a zone of joinder 22 that extends the full length of the zipper. This intermediate portion is part of the folded portion 4' of flange 4. The majority of the second zipper part comprising profiled closure member 6 and flange 8 is supported by the first zipper part and is not joined along a horizontal line to the front wall 10 of the bag body (although it may be effectively joined to the front wall at vertical end seals as explained below).

The entire slider-zipper assembly may be attached on the inside of the front wall 10 in part by means of the respective (horizontal or longitudinal) zones of joinder 18 and 20, and in part by means of respective vertical zones of joinder or seals 28 and 30 (see FIG. 2) located at the ends of the zipper. These zones of joinder are preferably formed by conduction heat sealing. For example, at the elevation of the profiled closure members, the ends of the profiled closure members 2 and 6 may be fused to each other by application of ultrasonic wave energy, while the confronting portions of the front wall 10 and the folded portion 4' of the flange 4 are fused (by conduction heat sealing) to the closure members 2 and 6 at the vertical seals 28 and 30. Below the elevation of the closure members 2 and 6, the front wall 10, the unfolded portion of the first flange 4, the second flange 8 and the folded portion 4' of the first flange 4 are fused or joined together at vertical seals 28 and 30. Further below the distal edge of the second flange 8, the front wall 10 and the unfolded and folded portions of flange 4 are fused or joined together at vertical seals 28 and 30, while above the closure members 2 and 6, the front wall 10 and the end of the fold portion 4' of the first flange 4 are fused or joined at vertical seals 28 and 30. Thus, as seen in FIG. 2, the vertical seals 28 and 30 extend the full height of the zipper, i.e., from the cusp of the folded flange 4 to the distal end of the flange 4.

As seen in FIG. 1, the long flange 4 is wrapped around the back of the zipper and joined to the front wall 10 at a height above the top of the slider 26. Although FIG. 1 shows an embodiment wherein the long flange 4 is connected to a closure member 2 having a male profile, the closure members of the zipper can be reversed so that the long flange is connected to the closure member with female profile instead.

The vertical seals 28 and 30 (shown in FIG. 2), in combination with the horizontal seals 18 and 20, separate the enclosed bag body into a product compartment P on the product side of the zipper and a zipper compartment Z outside the zipper but within the bag body, these compartments being indicated in FIG. 1.

Figure 5:
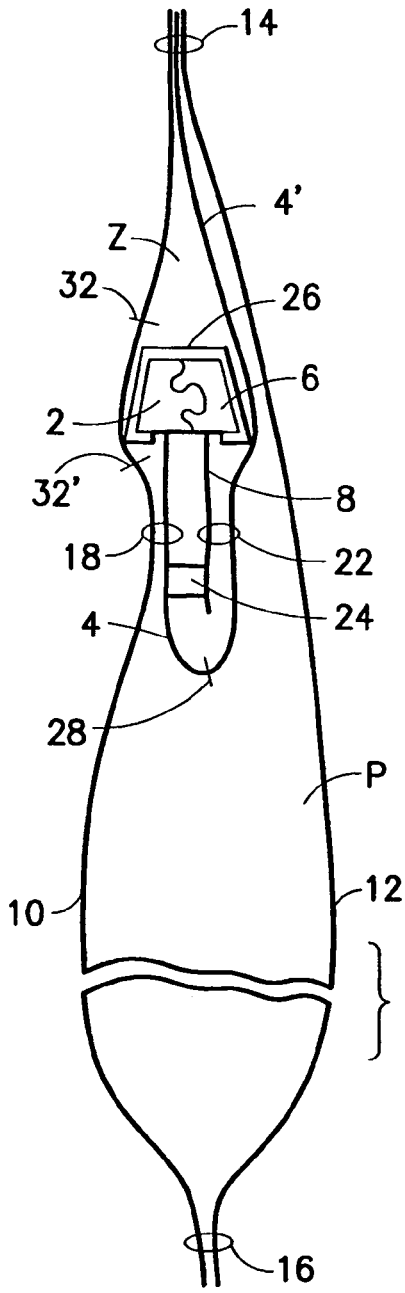
FIG. 5 is a drawing showing a sectional view of a reclosable package that is designed to open on its front panel in accordance with another embodiment of the present invention.

Optionally, the zipper may be as wide as the package, with the ends of the zipper captured in and sealed by a pair of package side seals. In accordance with a further alternative embodiment, the distal end section of the folded portion 4' of the long flange 4 can be captured in and sealed by the bag top seal 14, in which case the distal end section of the flange 4 is sandwiched between and joined to the upper margins of both the front wall 10 and the rear wall 12, as shown in FIG. 5.

The disclosed embodiment further includes a slider 26 mounted to or over the zipper to facilitate its opening and closing. To this end, moving the slider toward one side causes opposing sections of the profiled closure members 2 and 6 to disengage and moving the slider toward the opposite side brings opposing sections of the closure members into engagement. The slider for opening or closing the reclosable zipper is typically shaped so that the slider straddles the zipper profiles. The ends of the slider are open to allow the zipper to pass through. The slider and zipper could be designed so that the zipper is opened by a separating finger or plow carried by the slider. Alternatively, the slider could be provided with means other than a plow for causing the zipper strips to disengage The slider may be made in multiple parts and welded together or the parts may be constructed to be snapped together. The slider may also be of one-piece construction. The slider can be made using any desired method, such as injection molding. The slider can be molded from any suitable plastic, such as nylon, polypropylene, polystyrene, acetal, polyketone, polybutylene terephthalate, high-density polyethylene, polycarbonate, or ABS.

To facilitate opening of the package by the consumer, a closed line 32 (best seen in FIG. 2) of weakened tear resistance is formed in the section of front wall 10 that spans the zones of joinder 18 and 20. This closed line of weakened tear resistance is positioned to allow access to the slider 26 when a section bag making film encompassed by the closed line is removed. The upper and lower segments of the closed line of weakened tear resistance are respectively indicated in FIG. 1 by short lines designated by the numeral 32. As best seen in FIG. 2, this closed line 32 comprises two mutually parallel, spaced-apart straight line segments, the ends of which are connected by respective semicircular segments, thus forming an oval or racetrack shape. Preferably the closed line 32 of weakened tear resistance comprises a series of spaced perforations in the bag making film. These perforations may be formed during the bag making process. When the package is in an unopened state, the consumer can access the slider 26 by tearing the front wall 10 along the closed line 32 and removing the oval-shaped section (see FIG. 2) of bag material encompassed by that tear line. Initially the slider 26 will be in the fully closed park position. After removing the tear-out section of the front wall 10, the consumer can grip the slider 26 and move it in the opening direction, thereby opening the zipper.

The presence of perforations means that the front wall section between the permanent seals 18 and 20 cannot provide hermetic sealing for the package. Since, as previously discussed, the zipper does not provide means for hermetic sealing, additional steps must be taken in order to provide hermetic sealing.

The embodiment shown in FIG. 1 comprises means for hermetic sealing. More specifically, the zipper is constructed with a peel seal 24 between confronting portions of the flanges 4 and 8. The peel seal 26 provides hermetic sealing of the product compartment P even when the front wall section between the permanent seals 18 and 20 is perforated. After the zipper has been opened for the first time, the peel seal 24 must be broken in conventional fashion by pulling apart the portions of the zipper flanges 4 and 8 that lie between the peel seal and the profiled closure members of the zipper.

However, even after the peel seal is broken, the cusp of the folded long flange 4 still blocks the consumer's access to the package contents inside the product compartment P. Accordingly, a line of weakened tear resistance 28 is provided in the cusp of the folded flange 4. The line of weakening 28 runs along the flange generally parallel to the zipper longitudinal axis. The consumer must rupture the line of weakness 28 in order to finally access the package compartment P. The line of weakness 28 may, for example, take the form of a scoreline or a line of spaced perforations extending along the cusp of flange 4.

In accordance with an alternative embodiment of the invention, the peel seal can be eliminated and the means for ensuring a hermetic seal can be incorporated on the cusp of the flange 4. More specifically, a line of perforations formed in the flange cusp can be capped by a frangible strip (not shown in FIG. 1) of lightweight material, as disclosed in U.S. Pat. No. 5,023,122. This frangible strip seals the perforations, but tears readily when the perforated flange is ruptured along the perforation line. The sealing strip may be heat sealed to the perforated flange or the sealing strip may be adhesive backed to allow the strip to be bonded to the flange by adhesive. Alternatively, the sealing strip may be provided by extruding a thin layer of material over the perforations. The details of how to manufacture a sealing strip for capping perforations in a substrate are fully disclosed in U.S. Pat. No. 5,023,122, which is incorporated by reference herein.

Although not indicated in the drawings, the zipper flanges may carry a layer of sealant material to facilitate sealing to the bag making film in cases where the flanges are made of a material different than the bag making film material.

Figure 3:
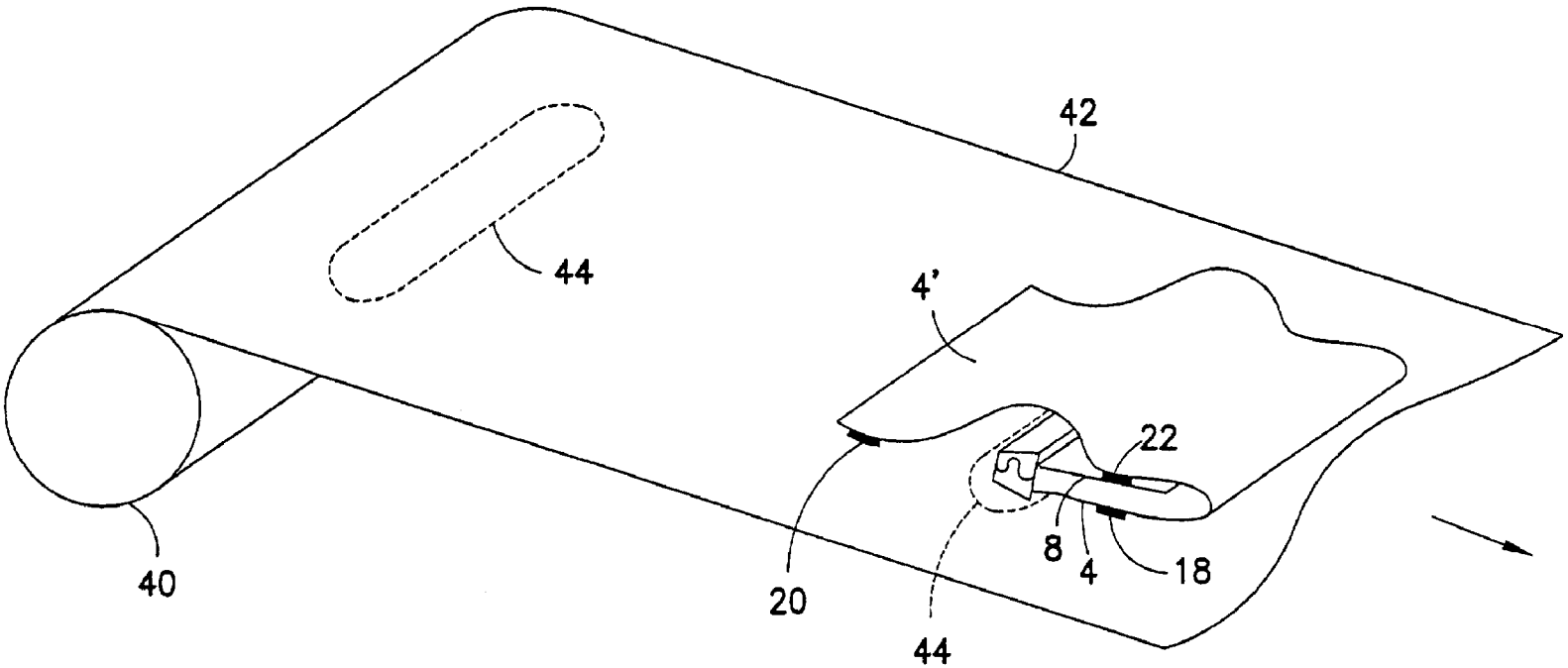
FIG. 3 is a drawing showing a method of applying a slider-zipper assembly to bag making film as a preliminary to forming, filling and sealing the package depicted in FIG. 1.

The present invention also encompasses methods of applying a slider-zipper assembly to bag making film. One method, which is useful in the manufacture of the embodiment depicted in FIG. 1, comprises the following steps (FIG. 3 shows the state of manufacture after all of these steps have been performed): (a) folding a portion of a long zipper flange 4 of a slider-zipper assembly around a short zipper flange 8; (b) joining the short zipper flange 8 to the folded-over portion 4' of the long zipper flange 4 along a band-shaped zone of joinder 22; (c) unwinding a length of bag making film 42 from a roll 40 and placing that length of film under tension; (d) placing the slider-zipper assembly on the tensioned length of bag making film in a predetermined position, as seen in FIG. 3; (e) joining an unfolded portion of the long zipper flange 4 to the bag making film 42 in a first zone of joinder 18 while the slider-zipper assembly is in the predetermined position relative to the bag making film; and (f) joining a distal section of the folded portion 4' of the long zipper flange 4 to the bag making film 42 in a second zone of joinder 20 while the slider-zipper assembly is in the predetermined position relative to the bag making film. At this juncture in the manufacturing process, the first and second zones of joinder are located on opposite sides of the interlocked first and second closure members of the zipper. In accordance with a further aspect of the invention, prior to attachment of the slider-zipper assembly, the bag making film 42 is weakened, e.g., by perforation, along a closed line 44 to form a tear-out section in the film. In this case the slider-zipper assembly will be placed with its closure profiles overlying the tear-out section in the film, as seen in FIG. 3. However, the weakening operation can be performed before or after application of slider-zipper assemblies to the film. This tear-out section should be sized and shaped to allow the consumer to easily manipulate the slider back and forth via the opening formed by removal of the tear-out section.

FIG. 3 shows a method of applying a slider-zipper assembly to bag making film as a preliminary to forming, filling and sealing the package depicted in FIG. 1. In the stage of manufacture depicted in FIG. 3, the web of bag making film 42 is unwound from the roll 40 and fed under tension in a machine direction toward a form-fill-seal machine (not shown). The direction of web advancement is indicated by the arrow in FIG. 3. The web may be advanced one package increment at regular intervals of time. At a first station, the film 42 is perforated at spaced intervals along a closed line 44. At the next station, a slider-zipper assembly is guided to a transverse position overlying the perforated region of the tensioned film; and the flange 4 is joined to the film 42 along mutually parallel bands or zones, e.g., by two pairs of opposed heat sealing jaws (not shown). The slider-zipper assembly is fed to the application station with the flange 4 already folded over as seen in FIG. 3. Also, the short flange 8 is already joined to the folded portion 4' of the long flange 4 by a conduction heat seal on one side and to the unfolded portion of the long flange 4 by a peel seal 24 on the other side before the slider-zipper assembly arrives at the application station. At the slider-zipper assembly application station, the permanent seals 18 and 20 are formed on opposite sides of the zipper closure members, thereby attaching the slider-zipper assembly to the bag making film. Then the film with applied slider-zipper assembly is advanced one package increment toward a conventional vertical form-fill-seal machine (not shown), where the package can be formed, filled and sealed.

To stabilize the zipper and provide slider end stops, the zipper ends are sealed to the front wall by means of vertical seals 28 and 30 (see FIG. 2). In the embodiment shown in FIG. 2, the ends of the front zipper part comprising profiled closure member 2 and flange 4 are sealed to the front wall 10 along the entire height of the zipper part, i.e., from horizontal seal 18 to horizontal seal 20. This can be accomplished in a number of ways. In accordance with one method, the zipper surfaces that confront the front wall 10 may be covered with low-melting-point sealant material (not shown), which is melted to fuse the zipper to the wall.

Figure 4:
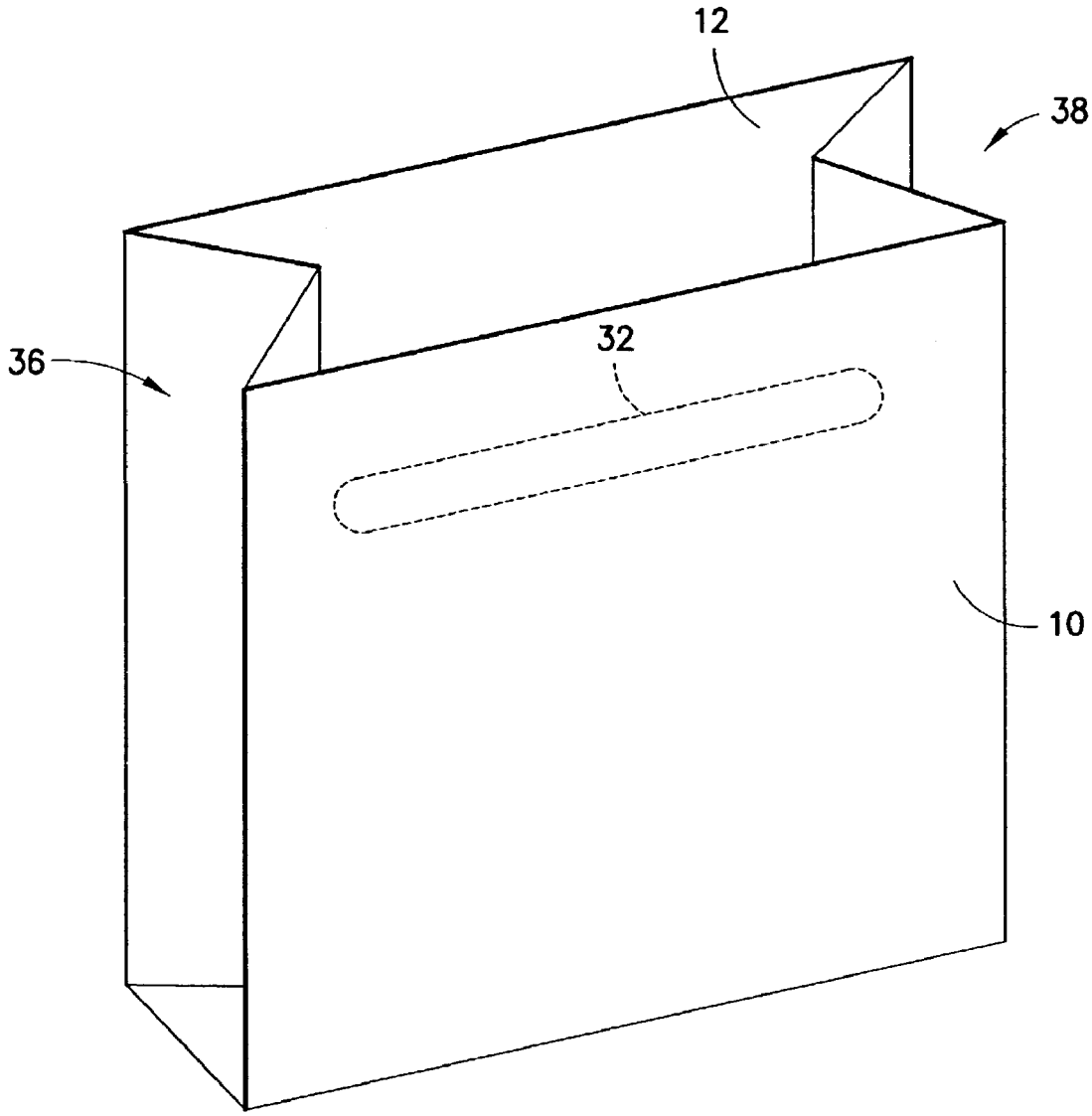
FIG. 4 is a drawing showing a gusseted bag having a front panel on which the slider-zipper assembly disclosed herein can be attached in accordance with another embodiment of the invention.

The present invention also has application in gusseted reclosable packages. FIG. 4 shows a gusseted back having front and rear walls or panels 10 and 12 connected by respective side gussets 36 and 38. Each side gusset comprises a respective pair of gusset panels connected by a respective fold line. A slider-zipper assembly of the type shown in FIGS. 1 and 2 can be attached on the inside of the front wall 10, placed with the slider and zipper profiles directly behind a tearout section bounded by a closed line 32 of perforations, previously described. The top of the gusseted back will be sealed shut, so that access to the interior of the bag will be via the cutout and the zipper, as previously described. When the top of the bag is sealed shut, the upper margins of the side gusset panels will be sandwiched between the adjoining portions of the upper margins of the front and rear walls.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the term "package" means a container, bag, pouch or other receptacle for objects, material or stuff. A container, bag, pouch or other receptacle is deemed to be a package even if not yet packed with objects, material or stuff. As used in the claims, the verb "joined" means fused, bonded, sealed, or adhered, whether by application of heat and/or pressure, application of ultrasonic energy, application of a layer of adhesive material or bonding agent, interposition of an adhesive or bonding strip, etc. As used in the claims, the term "wall" is used in a broad sense to include both a discrete piece of bag making material and a portion of a discrete piece of bag making material. In addition, as used in the claims, the term "flange" is intended to encompass flanges that are integrally formed with the profiled closure members, as well as separate pieces joined to the profiled closure members. The "lengthwise direction" of a flange is orthogonal to the longitudinal axis of the interlocked profiled closure members, while the "length" of a flange is the distance of a distal edge of the flange from a point where the flange connects to the associated profiled closure member, measured in the lengthwise direction.

The invention claimed is:

1. A reclosable package comprising:

a bag body having an interior space, said bag body comprising first and second walls of bag making material, said first wall opposing said second wall;

a flexible zipper joined to said first wall and disposed in said interior space of said bag body; and a slider mounted to said zipper, said slider being movable in a first direction along said zipper for opening said zipper and movable in a second direction along said zipper for closing said zipper, wherein said zipper comprises first and second zipper parts that are mutually engageable to close said zipper and mutually disengageable to open said zipper, said first zipper part comprising a first profiled closure member and a first flange connected to said first closure member, and said second zipper part comprising a second profiled closure member that is interlockable with said first closure member and a second flange connected to said second closure member, said first flange being longer than said second flange, wherein a first portion of said first flange is joined to said first wall along a first zone of joinder at an elevation below said first and second profiled closure members, and a second portion near a distal end of said first flange is joined to said first wall along a second zone of joinder at an elevation above said first and second profiled closure members.

2. The reclosable package as recited in claim 1, wherein said second zipper flange comprises a portion joined to a third portion of said first zipper flange in a respective third zone of joinder located between said first and second zones of joinder in the lengthwise direction of said first flange.

3. The reclosable package as recited in claim 1, wherein said first wall comprises a closed line of weakened tear resistance positioned to allow access to said slider when a section encompassed by said closed line is removed.

4. The reclosable package as recited in claim 3, wherein said closed line of weakened tear resistance comprises spaced perforations.

5. The reclosable package as recited in claim 1, further comprising a peel seal between said first and second flanges.

6. The reclosable package as recited in claim 1, wherein said first flange is folded and said second flange is disposed between first and second portions of said folded first flange.

7. The reclosable package as recited in claim 6, wherein said folded first flange comprises a line of weakened tear resistance disposed along a cusp of said folded first flange.

8. The reclosable package as recited in claim 7, wherein said line of weakened tear resistance comprises spaced perforations.

9. The reclosable package as recited in claim 1, wherein said first and second closure members are fused together at first and second ends of said zipper.

10. The reclosable package as recited in claim 1, wherein said first and second flanges are joined together along vertical seal lines at first and second ends of said zipper.

11. The reclosable package as recited in claim 1, wherein said respective edges of said first and second walls are joined to form first and second side seals.

12. The reclosable package as recited in claim 1, wherein said bag body further comprises first and second gusseted sides connected to said first and second walls.

13. A reclosable package comprising:

a bag body comprising first and second walls of bag making material;

a flexible zipper disposed between said first and second walls, said zipper comprising first and second zipper parts that are mutually engageable to close said zipper and mutually disengageable to open said zipper, said first zipper part comprising a first profiled closure member and a first flange connected to said first closure member, and said second zipper part comprising a second profiled closure member that is interlockable with said first closure member and a second flange connected to said second closure member, said first flange being longer than said second flange, wherein said first flange is joined to said first wall along first and second zones of joinder disposed at different heights on said first wall, and is joined to said second wall in said second zone of joinder, said second flange being joined to said first flange along a third zone of joinder disposed intermediate said first and second zones of joinder along the length of said first flange; and a slider mounted to said zipper, said slider being movable in a first direction along said zipper for opening said zipper and movable in a second direction along said zipper for closing said zipper.

14. The reclosable package as recited in claim 13, wherein said second zone of joinder is formed by a top seal, a distal end of said first flange being sandwiched between respective upper margins of said first and second walls.

15. The reclosable package as recited in claim 13, wherein said first wall comprises a closed line of weakened tear resistance positioned to allow access to said slider when a section encompassed by said closed line is removed.

16. The reclosable package as recited in claim 15, wherein said closed line of weakened tear resistance comprises spaced perforations.

17. The reclosable package as recited in claim 13, further comprising a peel seal between said first and second flanges.

18. The reclosable package as recited in claim 13, wherein said first flange is folded and said second flange is disposed between first and second portions of said folded first flange.

19. The reclosable package as recited in claim 18, wherein said folded first flange comprises a line of weakened tear resistance disposed along a cusp of said folded first flange.

20. The reclosable package as recited in claim 19, wherein said line of weakened tear resistance comprises spaced perforations.

21. The reclosable package as recited in claim 13, wherein said first and second closure members are fused together at first and second ends of said zipper.

22. The reclosable package as recited in claim 13, wherein said first and second flanges are joined together along vertical seal lines at first and second ends of said zipper.

* * * * *